US012339036B2

(12) United States Patent
Zhong et al.

(10) Patent No.: US 12,339,036 B2
(45) Date of Patent: Jun. 24, 2025

(54) FLOOR-STANDING AIR-CONDITIONING INDOOR UNIT AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Zhiyao Zhong, Guangdong (CN); Chao Cheng, Guangdong (CN); Jielin Peng, Guangdong (CN); Sun Gong, Guangdong (CN); Bo Wang, Guangdong (CN); Xin Chen, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 504 days.

(21) Appl. No.: 17/698,188

(22) Filed: Mar. 18, 2022

(65) Prior Publication Data

US 2022/0205655 A1 Jun. 30, 2022

Related U.S. Application Data

(63) Continuation of application No. PCT/CN2020/078397, filed on Mar. 9, 2020.

(30) Foreign Application Priority Data

Oct. 23, 2019 (CN) ..... 201911014533.4
Oct. 23, 2019 (CN) ..... 201921792187.8

(51) Int. Cl.
*F24F 7/007* (2006.01)

(52) U.S. Cl.
CPC ..... *F24F 7/007* (2013.01)

(58) Field of Classification Search
CPC .. F24F 1/028; F24F 1/0284; F24F 1/04; F24F 7/007; F24F 13/12; F24F 2013/1433
See application file for complete search history.

(56) References Cited

FOREIGN PATENT DOCUMENTS

CN 201637054 U 11/2010
CN 102012084 A * 4/2011
(Continued)

OTHER PUBLICATIONS

CN102012084A Translation (Year: 2011).*
(Continued)

*Primary Examiner* — Schyler S Sanks
(74) *Attorney, Agent, or Firm* — Scully, Scott, Murphy & Presser, P.C.

(57) ABSTRACT

A floor-standing air-conditioning indoor unit and an air conditioner are provided. The indoor unit has a housing, a top air outlet frame, a fan assembly and a driving device. The housing has an air inlet and a mounting port with an upward opening. An air duct is formed between the air inlet and the mounting port. The top air outlet frame is installed at the mounting port and movable up and down. The fan assembly is installed in the air duct and blows airflow to a lower port of the top air outlet frame and out from a front port of the top air outlet frame. The driving device has a driving member and a motion conversion member connected with the top air outlet frame. The driving member drives the motion conversion member to move along the first direction to move the top air outlet frame up and down.

16 Claims, 12 Drawing Sheets

(56) References Cited

FOREIGN PATENT DOCUMENTS

| | | | |
|---|---|---|---|
| CN | 103776094 | A | 5/2014 |
| CN | 104654540 | A | 5/2015 |
| CN | 104697142 | A | 6/2015 |
| CN | 106123253 | A | 11/2016 |
| CN | 106322530 | A | 1/2017 |
| CN | 109974084 | A | 7/2019 |
| CN | 110594864 | A | 12/2019 |
| CN | 110595026 | A | 12/2019 |
| CN | 210601957 | U | 5/2020 |
| JP | H09-184638 | A | 7/1997 |
| JP | 2015155764 | A | 8/2015 |
| KR | 20110018740 | A | 2/2011 |
| KR | 101243225 | B1 | 3/2013 |

OTHER PUBLICATIONS

International Search Report and Written Opinion dated Jul. 24, 2020 received in International Application No. PCT/CN2020/078397 together with an English language translation.
Request for the Submission of an Opinion dated Dec. 15, 2023 received in Korean Patent Application No. KR 10-2022-7009654.
First Office Action dated Feb. 7, 2024 received in Chinese Patent Application No. CN 201911014533.4.

* cited by examiner

FLOOR-STANDING AIR-CONDITIONING INDOOR UNIT AND AIR CONDITIONER

CROSS-REFERENCE TO RELATED APPLICATIONS

The present application is a continuation application of PCT International Application No. PCT/CN2020/078397, filed on Mar. 9, 2020, which claims the priority of the Chinese patent application Nos. 201921792187.8, and 201911014533.4 filed on Oct. 23, 2019. The disclosures of the aforementioned applications are incorporated in the present application by reference for all purposes. No new matter has been introduced.

FIELD

The present application relates to the field of air conditioners, and in particular, to a floor-standing air-conditioning indoor unit and an air conditioner.

BACKGROUND

At present, air conditioner is one of the essential electrical appliances in daily life. There are various types of air conditioners on the market, but the modes of air outflux of the air conditioners are relatively simple. Take the floor-standing air conditioner as an example, the floor-standing air conditioner usually has a conventional air outlet on the panel, but the floor-standing air conditioner having the conventional air outlet has a limited air supply range and a single air supply mode, which can't meet the different needs of users.

The above content is only used to assist in understanding the technical solution of the present application, and it does not mean that the above content is recognized as prior art.

SUMMARY

The main purpose of the present application is to provide a floor-standing air-conditioning indoor unit, aiming at solving at least the technical problems of single air supply mode and limited air supply range of the floor-standing air-conditioning indoor unit.

In order to achieve at least the above purpose, the floor-standing air-conditioning indoor unit provided by the present application includes a housing, a top air outlet frame, a fan assembly and a driving device;

- the housing is provided with an air inlet and a mounting port with an upward opening, an air duct is formed between the air inlet and the mounting port;
- the top air outlet frame is installed at the mounting port and movable in an up-down direction, a lower end and a front end of the top air outlet frame are open;
- the fan assembly is installed in the air duct and configured to blow airflow from the air inlet to a lower port of the top air outlet frame and then out from a front port of the top air outlet frame;
- the driving device is installed in the housing and includes a driving member and a motion conversion member driven by the driving member, the motion conversion member is connected with the top air outlet frame, and the driving member is configured to drive the motion conversion member to move along a first direction and drive the top air outlet frame to move in the up-down direction.

In an embodiment, the housing includes an outer housing and an air duct housing arranged in the outer housing, the mounting port is defined on a top surface of the air duct housing, the air duct is formed inside the air duct housing, and the top air outlet frame is installed in the air duct housing and movable in the up-down direction.

In an embodiment, the top air outlet frame has a first position out of the mounting port and a second position in the air duct housing, the driving device is configured to drive the top air outlet frame to move between the first position and the second position.

In an embodiment, a side wall of the top air outlet frame is provided with a positioning shaft, and the motion conversion member is defined with a guide chute, the positioning shaft is arranged in the guide chute and configured to move along the guide chute to drive the top air outlet frame to move in the up-down direction when the motion conversion member moves along the first direction.

In an embodiment, a side wall of the air duct housing is provided with another guide chute extending in the up-down direction and corresponding to the guide chute, the driving device is arranged outside the air duct housing, and the positioning shaft is passed through the another guide chute and connected with the guide chute.

In an embodiment, the positioning shaft is provided on a rear side wall of the top air outlet frame, the air duct housing is defined with a sliding groove extending along the first direction and corresponding to the rear side wall of the top air outlet frame, and the motion conversion member is slidably installed in the sliding groove, the first direction is consistent with a length direction of the air duct housing, and the guide chute is arranged at angles relative to the first direction and the up-down direction.

In an embodiment, the driving device further includes a pressing plate connected to the housing and covering the sliding groove, and the pressing plate is configured such that the motion conversion member is slidably installed in the sliding groove along the first direction.

In an embodiment, the first direction and the up-down direction are perpendicular to each other, and the guide chute is arranged at angles relative to both the first direction and the up-down direction.

In an embodiment, two positioning shafts and two guide chutes are included, each positioning shaft is received in one of the two guide chutes, and the two guide chutes are parallel to each other in the first direction.

In an embodiment, the motion conversion member is further defined with a buffer groove arranged at a lower end of the guide chute and communicating with the guide chute, and an angle formed between the buffer groove and a horizontal plane is smaller than an angle formed between the guide chute and the horizontal plane, and the buffer groove is configured such that the driving member drives the positioning shaft to move from the buffer groove to the guide chute when the driving member is started.

In an embodiment, the guide chute is smoothly connected with the buffer groove.

In an embodiment, the buffer groove is an arc groove.

In an embodiment, the driving device further includes a transmission gear, the driving member includes a driving motor, the motion conversion member is provided with a rack engaged with the transmission gear and extended along the first direction, and the driving motor is connected to the transmission gear and configured to drive the transmission gear to move the motion conversion member along the first direction.

In an embodiment, the motion conversion member includes a connecting plate and a toothed frame connected with the connecting plate, the connecting plate is defined with the guide chute, the toothed frame is provided with two opposite racks, and the transmission gear is meshed with the two racks.

In an embodiment, two driving motors and two transmission gears are included, each driving motor is fixedly connected with one transmission gear, and the two driving motors are configured to rotate synchronously.

In an embodiment, one of the top air outlet frame and the housing is provided with a sliding rail structure extending in the up-down direction, and the other of the top air outlet frame and the housing is provided with a sliding groove structure engaged with the sliding rail structure.

In an embodiment, a front side of the housing is provided with an air outlet located below the mounting port, the air duct housing is provided with another air outlet corresponding to the air outlet, the fan assembly is further configured to drive the airflow to the another air outlet and be blown out from the air outlet.

In an embodiment, a top plate of the housing is provided with an exit port corresponding to the mounting port of the air duct housing and configured for the top air outlet frame to be extended out.

The present application also provides an air conditioner, which includes an air conditioning outdoor unit and a floor-standing air-conditioning indoor unit which are connected through a refrigerant pipe, the floor-standing air conditioning indoor unit includes a housing, a top air outlet frame, a fan assembly and a driving device;

- the housing is provided with an air inlet and a mounting port with an upward opening, an air duct is formed between the air inlet and the mounting port;
- the top air outlet frame is installed at the mounting port and movable in an up-down direction, a lower end and a front end of the top air outlet frame are open;
- the fan assembly is installed in the air duct and configured to blow airflow from the air inlet to a lower port of the top air outlet frame and then out from a front port of the top air outlet frame;
- the driving device is installed in the housing and includes a driving member and a motion conversion member driven by the driving member, the motion conversion member is connected with the top air outlet frame, and the driving member is configured to drive the motion conversion member to move along a first direction and drive the top air outlet frame to move in the up-down direction.

The floor-standing air-conditioning indoor unit of the present application is provided with a mounting port with an upward opening on the housing, so that the top air outlet frame can be installed at the mounting port and movable in the up-down direction, the lower end and the front end of the top air outlet frame are open, and the fan assembly is configured to blow the airflow from the air inlet to the lower port of the top air outlet frame and then out from the front port of the top air outlet frame, so that the floor-standing air-conditioning indoor unit has the top air outlet mode, the top air outlet frame can move up and down, and thus it is convenient to adjust the air outlet height of the front port of the top air outlet frame, or the top air outlet frame 200 can be lowered into the housing when the top air outlet frame is not needed. Therefore, the air supply modes of the floor-standing air-conditioning indoor unit are diversified and the air supply range is wider.

At the same time, the motion conversion member is provided to connect with the top air outlet frame, the driving member is configured to drive the motion conversion member to move along the first direction to drive the top air outlet frame to move up and down, the first direction intersects with the up-down direction. Therefore, when the driving member drives the motion conversion member to move in the first direction, the motion conversion member can convert the motion in the first direction into the up-and-down movement of the top air outlet frame. This driving structure transfers a portion of movement in the up-down direction to the first direction, thereby reducing the space for the top air outlet frame to move in the up-down direction, making the entire structure more compact, and reducing the volume of the entire machine.

BRIEF DESCRIPTION OF THE DRAWINGS

In order to more clearly explain the embodiments of the present application or the technical solutions in the related art, the drawings needed in the description of embodiments or related art will be briefly introduced below. Obviously, the drawings in the following description are only some examples of the present application. For ordinary skills in the art, other drawings can be obtained according to these drawings without creative efforts.

Figure 1:
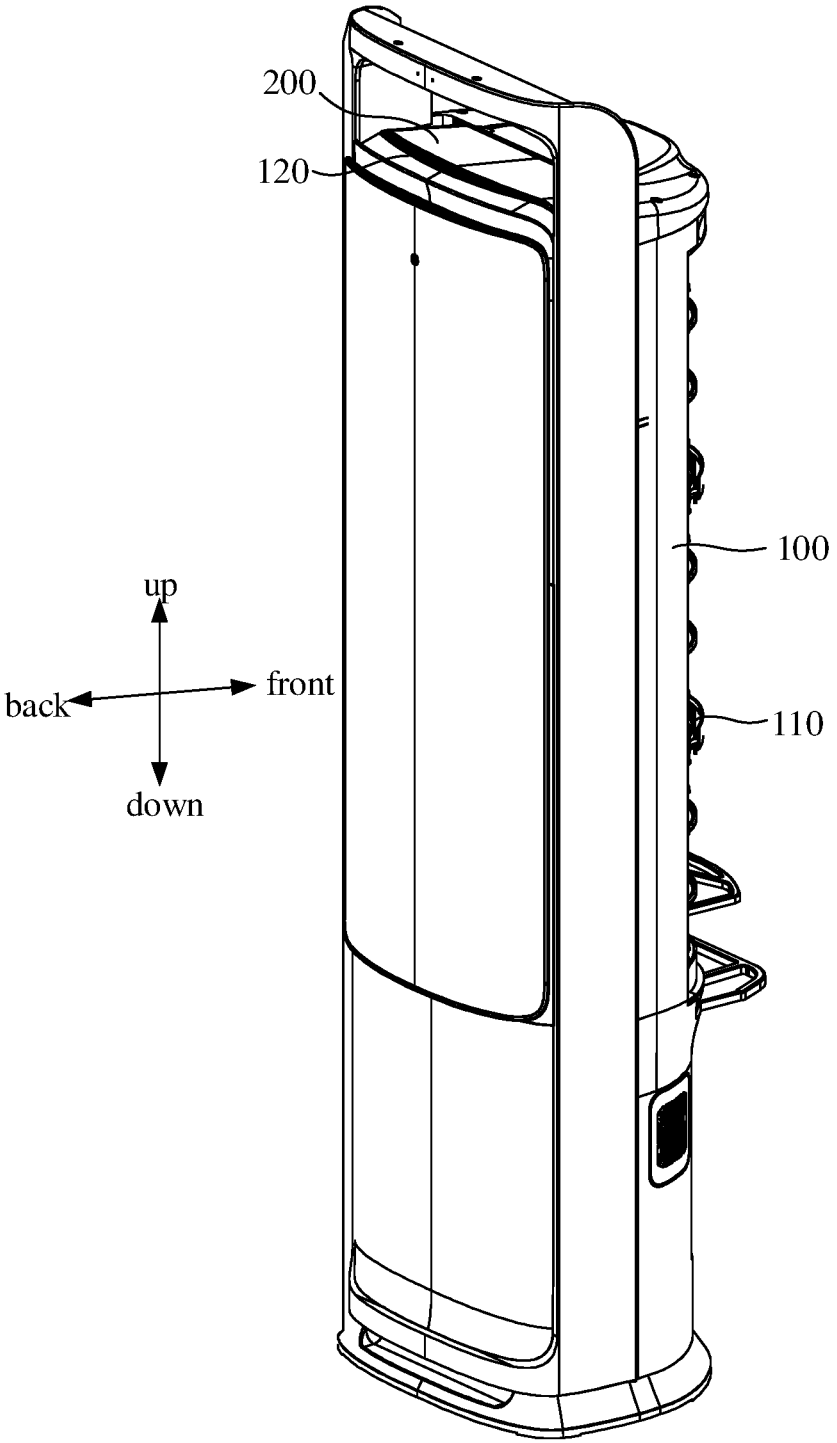
FIG. 1 is a structural schematic view of an embodiment of a floor-standing air-conditioning indoor unit.
Figure 2:
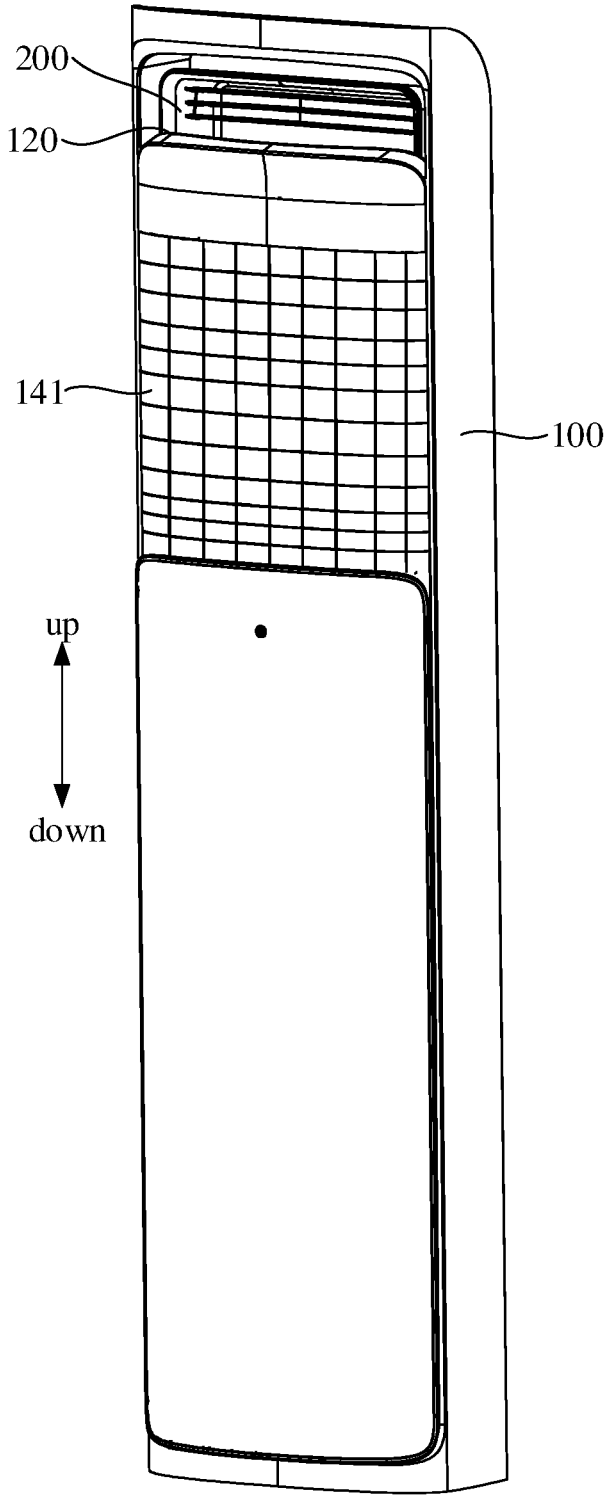
FIG. 2 is a structural schematic view of another embodiment of the floor-standing air-conditioning indoor unit.

Description of reference numerals shown in the figures is provided in the following table.

| Reference numerals | Name |
|---|---|
| 100 | Housing |
| 110 | Air inlet |
| 120 | Mounting port |
| 130 | Air duct |
| 141 | Air outlet |
| 150 | Air duct housing |
| 151 | Guide chute |
| 152 | Sliding groove |
| 153 | Air outlet |

-continued

| Reference numerals | Name |
|---|---|
| 160 | Sliding rail structure |
| 200 | Top air outlet frame |
| 210 | Positioning shaft |
| 220 | Lower port |
| 230 | Front port |
| 240 | Sliding groove structure |
| 400 | Driving device |
| 410 | Driving member |
| 420 | Motion conversion member |
| 421 | Guide chute |
| 422 | Buffer groove |
| 423 | Rack |
| 424 | Connecting plate |
| 425 | Toothed frame |
| 430 | Pressing plate |
| 440 | Transmission gear |

The realization of the purposes, functional features and advantages of the present application will be further explained with reference to the accompanying drawings in combination with the embodiments.

DETAILED DESCRIPTION OF EMBODIMENTS

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

It should be noted that, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. Besides, the meaning of "and/or" appearing in the disclosure includes three parallel schemes. For example, "A and/or B" includes only A, or only B, or both A and B.

The present disclosure provides a floor-standing air-conditioning indoor unit.

In an embodiment of the present disclosure, as shown in FIGS. 1-11, the floor-standing air-conditioning indoor unit includes a housing 100, a top air outlet frame 200, a fan assembly (not shown) and a driving device 400. The housing 100 has an air inlet 110. The housing 100 is provided with a mounting port 120 with an opening facing upward. An air duct 130 is formed between the air inlet 110 and the mounting port 120. The top air outlet frame 200 is installed at the mounting port 120 and movable in an up-down direction, a lower end and a front end of the top air outlet frame 200 are open, and a side wall of the top air outlet frame 200 is provided with a positioning shaft 210. The fan assembly (not shown) is installed in the air duct 130, and is configured to draw airflow from the air inlet 110 and blow the airflow to a lower port 220 of the top air outlet frame 200 and out from a front port 230 of the top air outlet frame 200. The driving device 400 is installed in the housing 100. The driving device 400 includes a driving member 410 and a motion conversion member 420 driven by the driving member 410. The motion conversion member 420 is connected with the top air outlet frame 200. The driving member 410 is configured to drive the motion conversion member 420 to move in a first direction and thus to drive the top air outlet frame 200 to move in the up-down direction. The first direction intersects with the up-down direction.

In this embodiment, the shape of the housing 100 can be selected and set according to the use requirements and design requirements. Floor-standing air-conditioning indoor units are usually extended in the up-down direction. The cross section of the housing 100 can be circular, elliptical, rectangular, irregularly-shaped, or the like, which is not specifically limited here. The shape of the cross section of the top air outlet frame 200 can be any one of various shapes, such as a circular shape, an elliptical shape, a rectangular shape, an irregular shape, or the like. The shape of the air inlet 110 can be circular, rectangular, elliptical, irregular, or the like, or be formed by a plurality of micropores. The air inlet 110 may be an indoor air inlet 110 and/or a fresh air inlet 110. The size of the mounting port 120 should be set to allow the top air outlet frame 200 to pass through. The shape and size of the mounting port 120 can be matched with the shape and size of a top plate of the top air outlet frame 200 in order to improve the air leakage prevention effect and the moving effect of the top air outlet frame 200. The mounting port 120 can be provided on a top plate of the housing 100 or at another position, so that the opening of the mounting port 120 is upward, and the top air outlet frame 200 can move up and down. A heat exchanger can be provided in the air duct 130, so that cold air or hot air after heat exchange can be blown out.

The top air outlet frame 200 can be installed on the housing 100, or on other structures inside the housing 100, as long as the top air outlet frame 200 is installed at the mounting port 120. The top air outlet frame 200 can be moved up and down manually, or be driven up and down by the driving device 400. The top air outlet frame 200 can slide up and down through a chute-rail structure, or can move up and down through a screw adjustment structure, a screw rod structure, a rack 423 and pinion structure, or the like. For example, the top air outlet frame 200 has a thin-walled cavity structure. It should be noted that the front end of the top air outlet frame 200 faces the users after the floor-standing air-conditioning indoor unit is installed in place. The lower port 220 refers to the opening at the lower end of the top air outlet frame 200, and the front port 230 refers to the opening at the front end of the top air outlet frame 200. By making the lower end and the front end of the top air outlet frame 200 open, the air flow flows into the cavity of the top air outlet frame 200 from the lower port 220 of the top air outlet frame 200 and can flow out from the front port 230.

The housing 100 can be a single-layer shell-like structure. If the air duct 130 is formed in the single-layer housing 100, the mounting port 120 with the upward opening is defined on the single-layer housing 100. At this time, the top air outlet frame 200 can extend out of the housing 100. The entire top air outlet frame 200 can extend out of the housing 100, that is, the top air outlet frame 200 can extend out of the housing 100 in the process of moving up and down. In this way, the front port 230 of the top air outlet frame 200 is always communicated with the room, and the air outlet height and range of the top air outlet frame 200 can be adjusted by moving the top air outlet frame 200 up and down. It is also possible to make the top air outlet frame 200 move to a position where it is extended out of the housing 100 and to a position where it is accommodated under the mounting port 120. In this way, when top air outlet is required, the top air outlet frame 200 is moved to extend out of the housing 100, and the air flow can be blown out from the front port 230. On the other hand, when the top air outlet is not required, the top air outlet frame 200 can be moved to be under the front port 230 and the housing 100 can block the front port 230 of the top air outlet frame 200, so that the air flow cannot be blown out from the front port 230. In this way, the air supply modes are more diversified, and at the same time, when the top air outlet mode is not needed, the top air outlet frame 200 can be lowered into the housing 100, thereby reducing the height of the entire machine and making the occupied space of the entire machine small.

In an embodiment, referring to FIG. 3, FIG. 4, FIG. 6 and FIG. 8, the housing 100 includes an outer housing (not labeled) and an air duct housing 150 installed in the outer housing (not labeled), the mounting port 120 is located at a top surface of the air duct housing 150, the air duct 130 is formed inside the air duct housing 150, and the top air outlet frame 200 can be installed in the air duct housing 150 and movable in the up-down direction. The air inlet 110 can be provided on the air duct housing 150 or on the outer housing (not labeled). The air entering the air duct 130 can be hot air, indoor air, fresh air, or other purified airflows. A structure such as a heat exchanger can also be provided in the air duct 130. The outer housing (not labeled) is matched with the air duct housing 150 in shape. The air duct housing 150 can be integrally formed or formed by splicing two sub-housings. The top plate of the outer housing (not labeled) and the top plate of the air duct housing 150 can be spaced from each other to define a sufficient moving space or a small gap therebetween, or the top plate of the outer housing (not labeled) and the top plate of the air duct housing 150 can be attached to each other. Then, when there is enough space between the top plate of the outer housing (not labeled) and the top plate of the air duct housing 150, the top air outlet frame 200 can be moved up and down in the outer housing (not labeled). At this time, an air outlet 141 can be defined on the outer housing (not labeled) to correspond to the front port 230 of the top air outlet frame 200, and a length of the air outlet 141 can be greater than or equal to a moving stroke of the top air outlet frame 200. The air outlet height of the front port 230 can be adjusted by moving the front port 230 up and down and adjusting the position of the front port 230.

Alternatively, it is also possible to provide an exit port on the top plate of the outer housing (not labeled) corresponding to the mounting port 120 of the air duct housing 150, which is suitable for the top air outlet frame 200 to be extended out. In this way, the airflow can be directly blown into the room from the front port 230 of the top air outlet frame 200, and the height of the outer housing (not labeled) is reduced, so that the volume of the entire machine is more compact. At this time, the top air outlet frame 200 can be always extended out of the outer housing (not labeled), the height of the top air outlet frame 200 out of the outer housing can be adjusted to adjust the height of air outlet, thereby expanding the air supply range and meeting different air supply requirements of the users. In an embodiment, the top air outlet frame 200 has a first position out of the mounting port 120 and a second position in the air duct housing 150, the driving device 400 is configured to drive the top air outlet frame 200 to move between the first position and the second position. In this way, when the top air outlet mode is not needed, the top air outlet frame 200 can be hidden in the air duct housing 150, thereby reducing the height of the entire machine and the occupied space of the entire machine.

The fan assembly (not shown) can include only one fan, which may be an axial fan, a centrifugal fan or a cross-flow fan. The position of the air inlet 110 can be adjusted according to the type of fan used, which is not specifically limited here. A wind wheel and a motor can be included, and the motor drives the wind wheel to rotate, thereby driving enough airflow to enter the air duct 130 from the air inlet 110, blow to the lower port 220 of the top air outlet frame 200 and enter the cavity of the top air outlet frame 200, and then blow out from the front port 230 of the top air outlet frame 200.

There are many ways to connect the motion conversion member 420 with the top air outlet frame 200, as long as that the motion of the motion conversion member 420 in the first direction can be converted into the movement of the top air outlet frame 200 in the up-down direction. In an embodiment, the positioning shaft 210 is provided on the side wall of the top air outlet frame 200, and a guide chute 421 is defined on the motion conversion member 420. The positioning shaft 210 is arranged in the guide chute 421 and configured to move along the guide chute 421 when the motion conversion member 420 moves along the first direction, which is suitable for driving the top air outlet frame 200 to move up and down.

Positioning shafts 210 can be provided on the left and right side walls of the top air outlet frame 200, or on the rear side wall of the top air outlet frame 200. The driving member 410 can be a driving motor or another driving member 410 capable of driving the motion conversion member 420 to move in the first direction. The first direction and the up-down direction can be disposed perpendicular to each other or at another angle relative to each other. The first direction can be a horizontal direction, that is, the front-back direction, the left-right direction, or the direction at a certain angle relative to the front-back direction or the left-right direction. An extension direction of the guide chute 421 can be the front-back direction, the left-right direction, or be at certain angles relative to the front-back direction, the left-right direction and the up-down direction.

The positioning shafts 210 can be disposed to extend out of the guide chute 421, or be wholly installed in the guide chute 421. Diameters of the positioning shafts 210 should match a width of the guide chute 421. By defining the guide chute 421 on the motion conversion member 420, the positioning shafts 210 are arranged in the guide chute 421. The positioning shafts 210 can be moved along the extension direction of the guide chute 421. In this way, when the driving member 410 drives the motion conversion member 420 to move along the first direction, the positioning shafts 210 move in the guide chute 421, thereby driving the top air outlet frame 200 to move up and down. Through the structure of the positioning shafts 210 with the motion conversion member 420, the up-and-down movement of the top air outlet frame 200 can be implemented by only setting a positioning shaft 210 on the top air outlet frame 200, so that the structure of the top air outlet frame 200 is simpler, the overall weight of the top air outlet frame 200 is reduced, and the driving force for driving the top air outlet frame 200 to move up and down is smaller. At the same time, the driving mode is simple and reliable, easy to realize, and the required moving space is small, which makes the overall structure more compact and further reduces the volume of the entire machine. In other embodiments, it is also possible to convert the movement of the motion conversion member 420 along the first direction into the movement of the top air outlet frame 200 along the up-down direction by defining a guide chute 421 on the top air outlet frame 200 and providing a positioning shaft 210 on the motion conversion member 420.

The floor-standing air-conditioning indoor unit of the present application is provided with a mounting port 120 with an upward opening on the housing 100, so that the top air outlet frame 200 can be installed at the mounting port 120 and movable in the up-down direction, the lower end and the front end of the top air outlet frame 200 are open, and the fan assembly (not shown) is configured to blow the airflow from the air inlet 110 to the lower port 220 of the top air outlet frame 200 and subsequently out from the front port 230 of the top air outlet frame 200, so that the floor-standing air-conditioning indoor unit has the top air outlet mode, the top air outlet frame 200 can move up and down, and thus it is convenient to adjust the air outlet height of the front port 230 of the top air outlet frame 200, or the top air outlet frame 200 can be lowered into the housing 100 when the top air outlet frame 200 is not needed. Therefore, the air supply modes or forms of the floor-standing air-conditioning indoor unit are diversified and the air supply range is expanded.

At the same time, the motion conversion member 420 is provided to connect with the top air outlet frame 200, the driving member 410 is configured to drive the motion conversion member 420 to move along the first direction to drive the top air outlet frame 200 to move up and down, the first direction intersects with the up-down direction. Therefore, when the driving member 410 drives the motion conversion member 420 to move in the first direction, the motion conversion member 420 can convert the motion in the first direction into the up-and-down movement of the top air outlet frame 200. This driving structure transfers a portion of movement in the up-down direction to the first direction, thereby reducing the space for the top air outlet frame 200 to move in the up-down direction, making the entire structure more compact, and reducing the volume of the entire machine, further, the driving mode is simple in structure and easy to realize.

In practical application, referring to FIGS. 4, 5, 7 and 9, the first direction and the up-down direction are perpendicular to each other, and the guide chute 421 is arranged at angles relative to the first direction and the up-down direction. By making the first direction perpendicular to the up-down direction, the first direction can be the front-back direction or the left-right direction. When the first direction is the front-back direction, the positioning shafts 210 are arranged on the left and right side walls of the top air outlet frame 200. When the first direction is the left-right direction, the positioning shafts 210 are disposed on the rear side wall of the top air outlet frame 200. The extension direction of the guide chute 421 is set at angles relative to the first direction and the up-down direction. In this way, when the positioning shafts 210 move in the guide chute 421, the movement of the motion conversion member 420 in the first direction can be converted into the up-and-down movement. The angle between the guide chute 421 and the up-down direction is greater than 0 degree and less than 90 degrees, and preferably greater than or equal to 30 degrees and less than or equal to 60 degrees. The angle between the guide chute 421 and the up-down direction can be 30 degrees, 35 degrees, 40 degrees, 45 degrees, 50 degrees, 55 degrees, 60 degrees, or the like. In this way, the guide chute 421 can better convert the movement of the motion conversion member 420 along the first direction into the up-and-down movement of the top air outlet frame 200.

Figure 6:
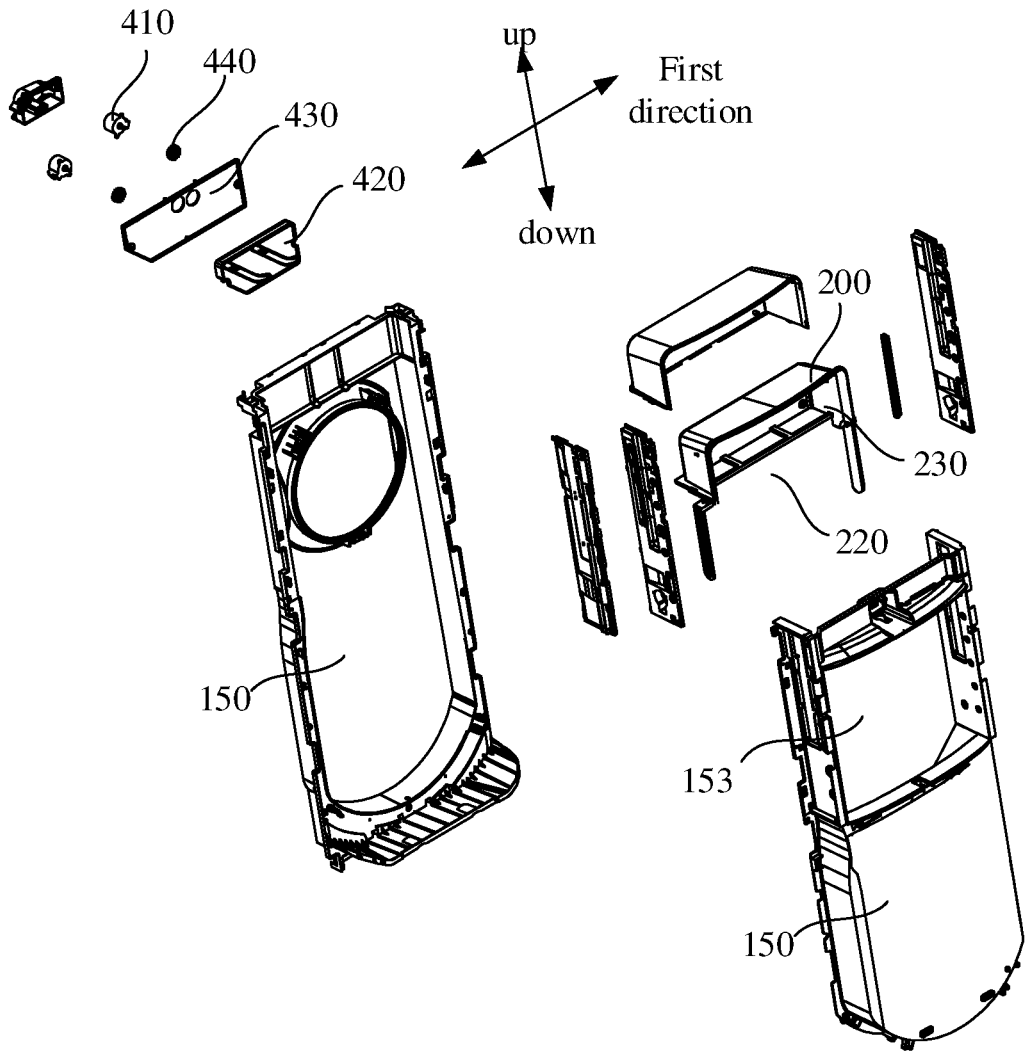
FIG. 6 is an exploded view of the floor-standing air-conditioning indoor unit in FIG. 3.
Figure 8:
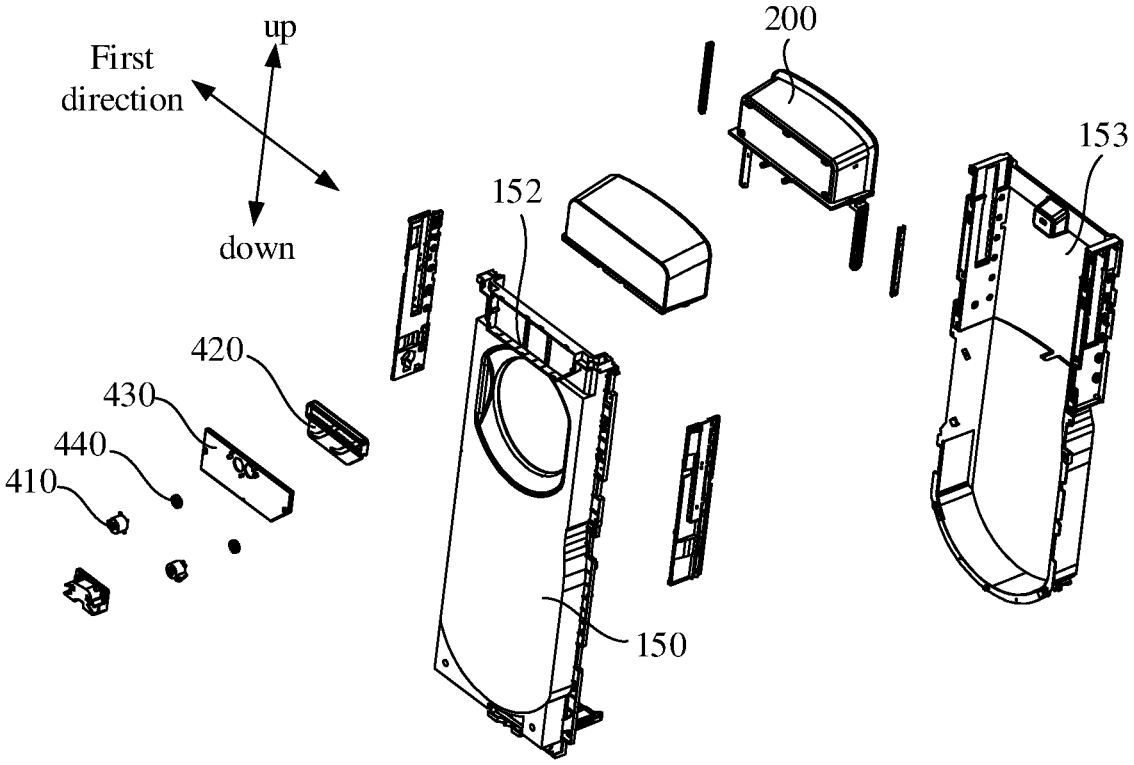
FIG. 8 is an exploded view of the floor-standing air-conditioning indoor unit of FIG. 3, viewed from another angle.
Figure 10:
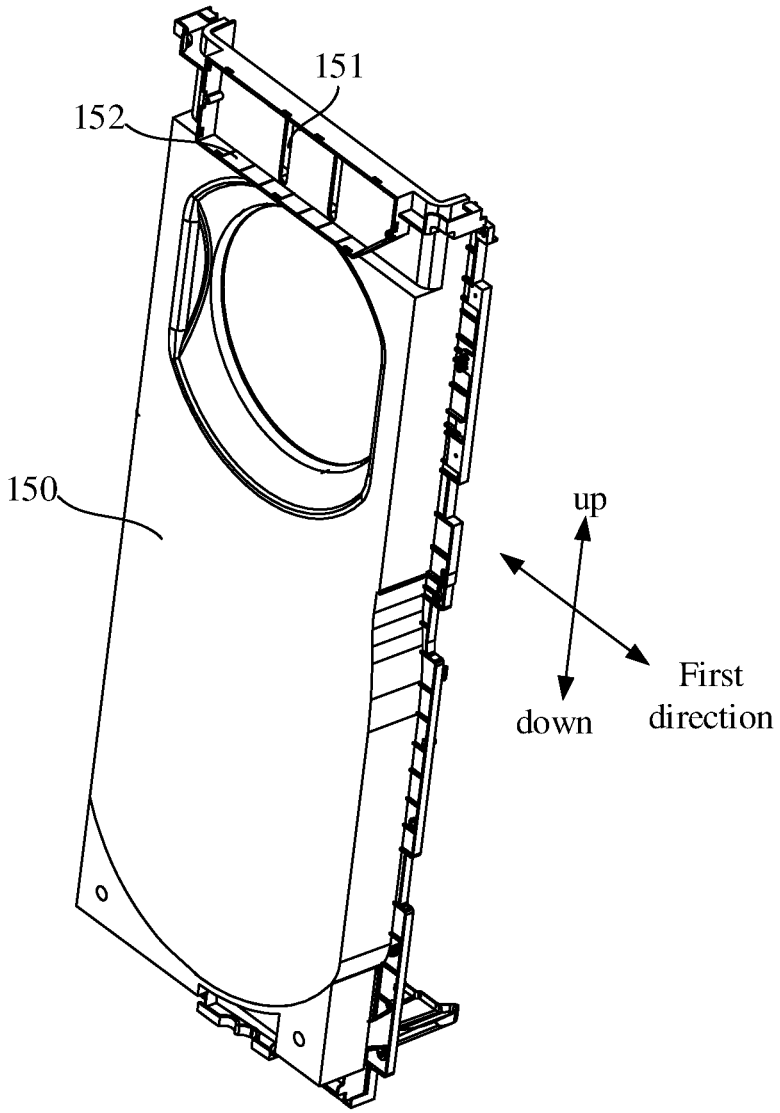
FIG. 10 is a structural view of an embodiment of an air duct housing in FIG. 8.

In an embodiment, referring to FIGS. 6, 8 and 10, the side wall of the air duct housing 150 is provided with a guide chute 151 extending in the up-down direction, the driving device 400 is arranged outside the air duct housing 150, the guide chute 421 is arranged corresponding to the guide chute 151, and the positioning shafts 210 are passed through the guide chute 151 and connected with the guide chute 421.

In this embodiment, the guide chute 151 is defined on the side wall of the air duct housing 150 and extended in the up-down direction, so that the guide chute 151 can guide and limit the positioning shafts 210. Since the top air outlet frame 200 is installed inside the air duct housing 150, and the driving device 400 is arranged outside the air duct housing 150, the driving device 400 does not interfere with the movement of the positioning shaft 210. The positioning shafts 210 are passed through the guide chute 151 firstly and then connected into the guide chute 421. When the driving member 410 drives the motion conversion member 420 to move along the first direction, the positioning shafts 210 move along the extension direction of the guide chute 421, because of the restriction of the guide chute 151, the positioning shafts 210 can only move up and down in the guide chute 151, and the positioning shafts 210 are prevented from swinging, shaking, deviating from the track and other phenomena. Thus the process of moving the top air outlet frame 200 up and down is smoother and more accurate.

Figure 4:
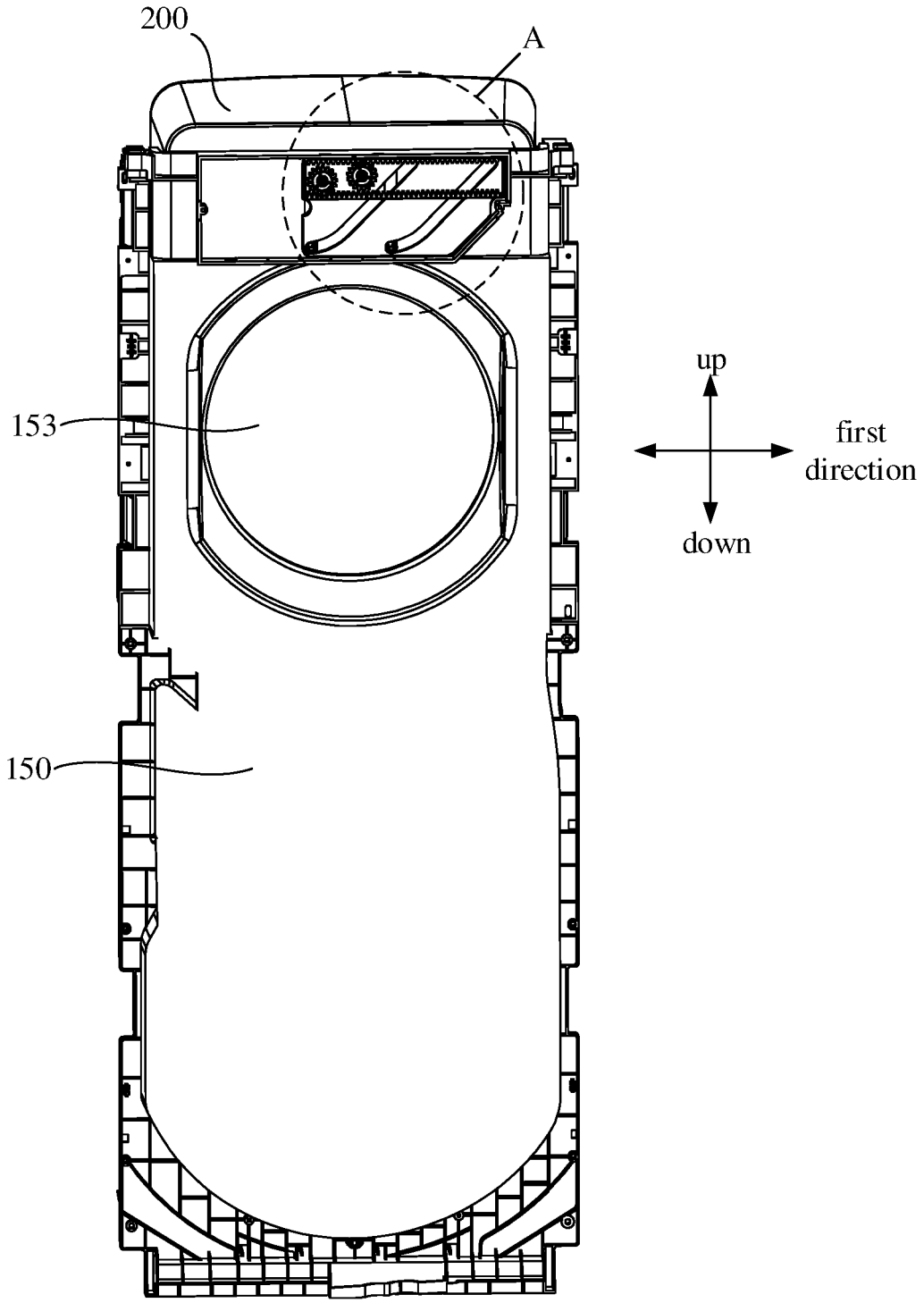
FIG. 4 is a schematic structural view of the floor-standing air-conditioning indoor unit of FIG. 3, viewed from another angle.
Figure 5:
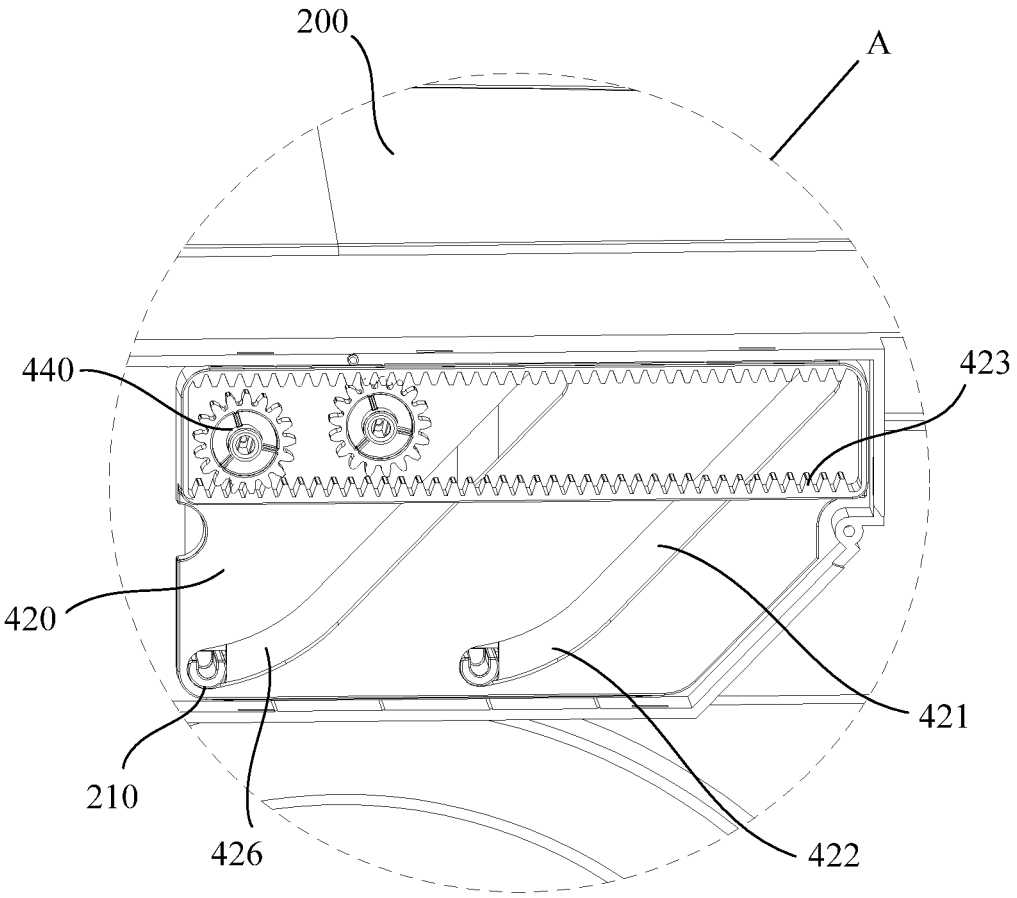
FIG. 5 is an enlarged view of portion A in FIG. 4.
Figure 11:
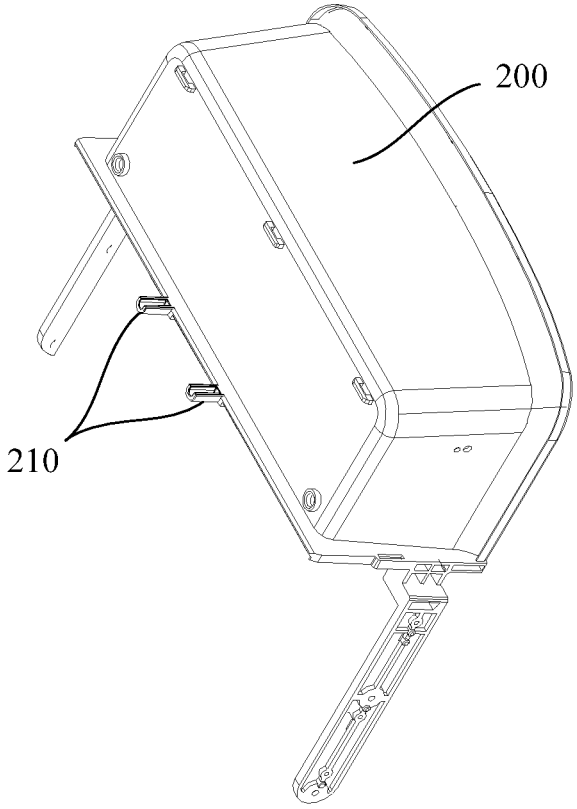
FIG. 11 is a schematic structural view of an embodiment of a top air outlet frame of the floor-standing air-conditioning indoor unit.

For example, as shown in FIGS. 4, 5 and 11, the positioning shafts 210 are arranged on the rear side wall of the top air outlet frame 200. The air duct housing 150 is provided with a sliding groove 152 extending along the first direction. The motion conversion member 420 is slidably installed in the sliding groove 152. The first direction is consistent with a length direction of the air duct housing 150, and the guide chute 421 is arranged at angles relative to the first direction and the up-down direction.

In this embodiment, the height direction of the air duct housing 150 is consistent with the up-down direction, and thus the length direction of the air duct housing 150 is consistent with a length direction of the top plate of the air duct housing 150. The first direction coincides with the length direction of the air duct housing 150, and thus the first direction is the left-right direction. By providing the positioning shafts 210 on the rear side wall of the top air outlet frame 200, and the first direction being consistent with the length direction of the air duct housing 150, the path of the motion conversion member 420 moving along the first direction is longer than that of the motion conversion member 420 when the positioning shafts 210 are arranged on the left and right side walls of the top air outlet frame 200, so that the up-down movement stroke of the top air outlet frame 200 can be longer. By arranging the sliding groove 152 along the first direction on the rear side wall of the top air outlet frame 200, the motion conversion member 420 can be slidably installed in the sliding groove 152, and the sliding groove 152 provides a sliding space for the motion conversion member 420, so that the motion conversion member 420 can move more smoothly along the first direction. At the same time, only a small moving space is needed for the motion conversion member 420 to drive the top air outlet frame 200 to move up and down, the entire of the driving device 400 occupies a small space, which makes the entire structure more compact.

Figure 3:
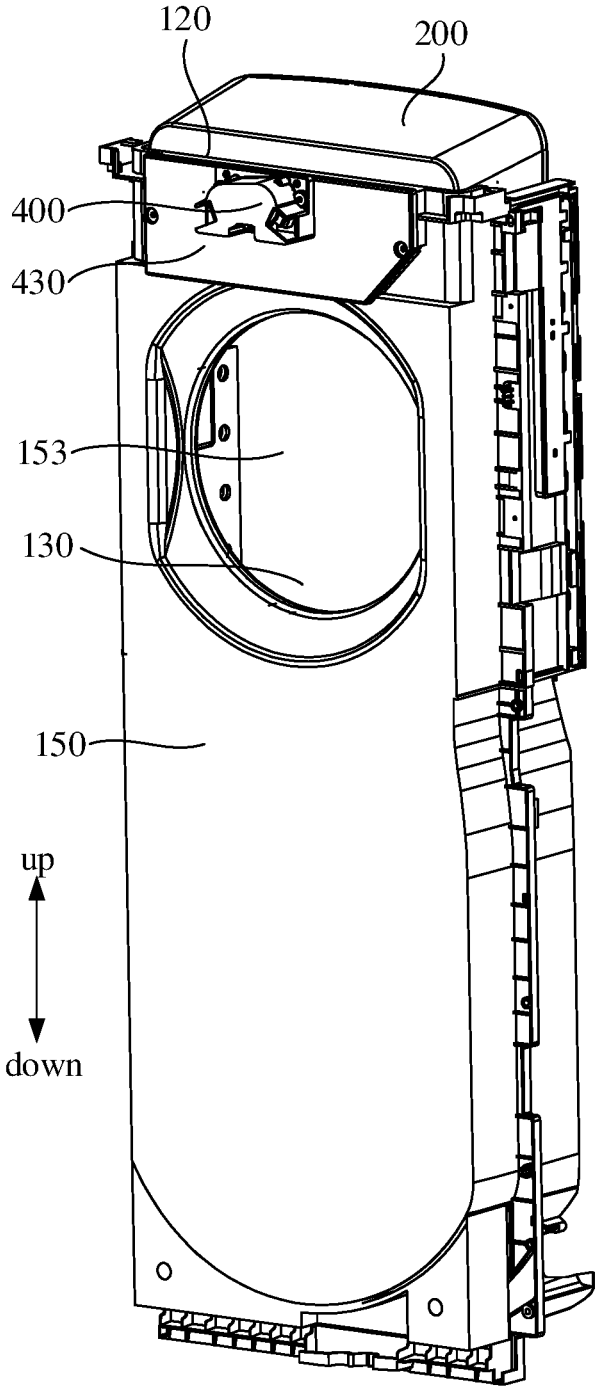
FIG. 3 is a structural schematic view of still another embodiment of the floor-standing air-conditioning indoor unit.
Figure 7:
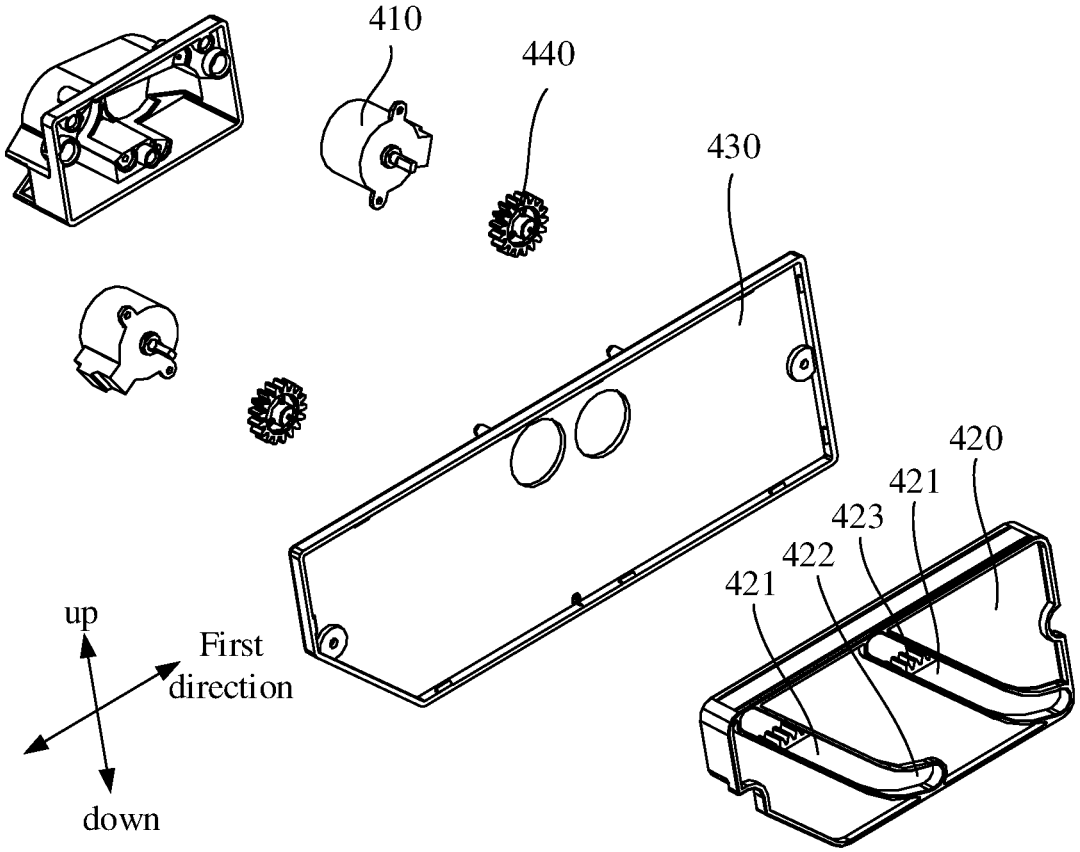
FIG. 7 is an exploded view of a driving device in FIG. 6.
Figure 9:
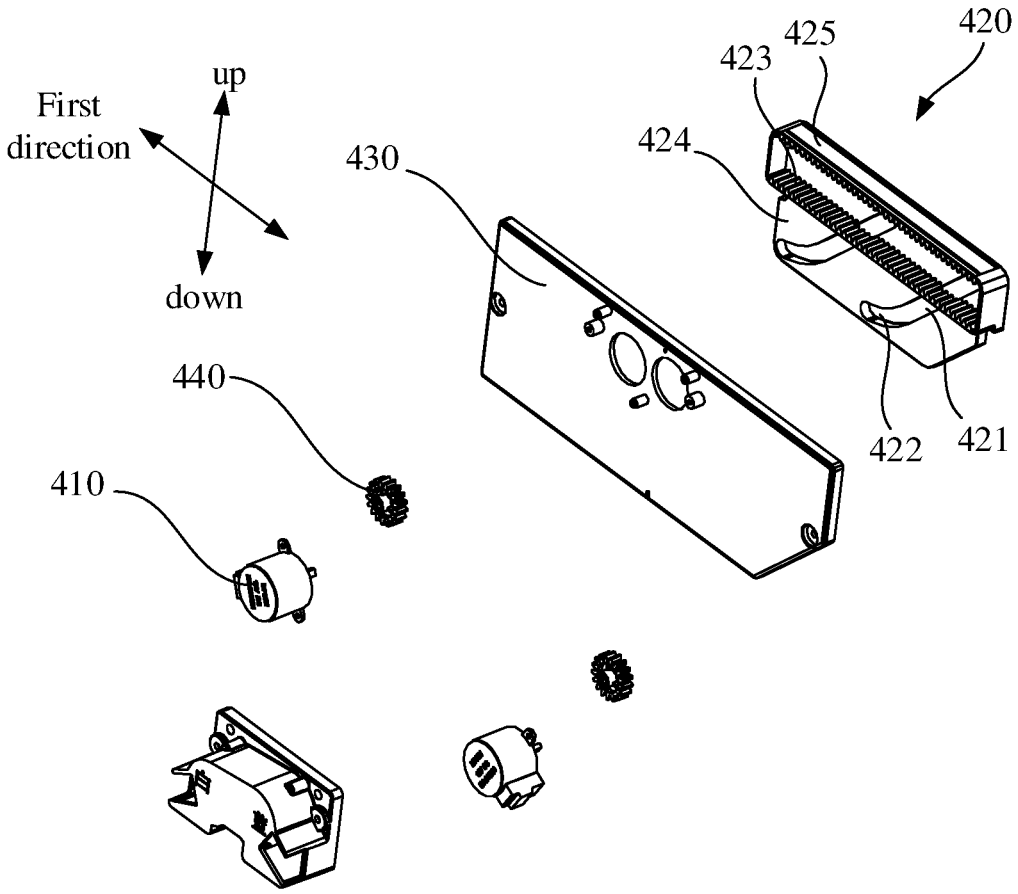
FIG. 9 is an exploded view of the driving device in FIG. 8.

In combination with the above-mentioned embodiment with the sliding groove 152, further, as shown in FIGS. 3, 7 and 9, the driving device 400 further includes a pressing plate 430, the pressing plate 430 is connected to the housing 100 and covers the sliding groove 152, the pressing plate 430 is configured, such that the motion conversion member 420 can be slidably installed in the sliding groove 152 along the first direction.

In this embodiment, the pressing plate 430 can be connected to the housing 100 by screws, clamping, bonding, welding, or the like. The pressing plate 430 is arranged to cover the sliding groove 152, so that a sliding space is formed between the pressing plate 430 and inner wall surfaces of the sliding groove 152 to limit the motion conversion member 420. In this way, the motion conversion member 420 can stably slide in the sliding groove 152 along the first direction.

In an embodiment, referring to FIGS. 4 to 11, there are two positioning shafts 210 and two guide chutes 421, each positioning shaft 210 is passed through a guide chute 421, and the two guide chutes 421 are parallel in the first direction. By providing two positioning shafts 210 and two guide chutes 421, the two guide chutes 421 are arranged in parallel in the first direction, and thus, the up-and-down movement of the top air outlet frame 200 is more stable, the stress on a single positioning shaft 210 can be reduced, and the service life of the positioning shafts 210 can be prolonged.

In an embodiment, as shown in FIGS. 5, 7 and 9, the motion conversion member 420 is further provided with a buffer groove 422, the buffer groove 422 is arranged at the lower end of the guide chute 421 and communicates with the guide chute 421. An angle formed between the buffer groove 422 and a horizontal plane is smaller than an angle formed between the guide chute 421 and the horizontal plane, and the buffer groove is configured, such that the driving member 410 drives the positioning shaft 210 to move from the buffer groove 422 to the guide chute 421 when the driving member 410 is started.

The horizontal plane refers to a horizontal plane relative to the ground. When the first direction coincides with the up-down direction. The angle between the guide chute 421 and the horizontal plane is 90 degrees, so it is only needed to make the angle between the buffer groove 422 and the horizontal plane less than 90 degrees to play a role of buffer and guide to the positioning shaft 210. When the first direction is set at an angle relative to the up-down direction, the extension direction of the guide chute 421 should be set at angles relative to both the first direction and the up-down direction. At this time, the buffer groove 422 and the guide chute 421 should extend toward the same direction, and the angle between the buffer groove 422 and the horizontal plane is smaller than the angle between the guide chute 421 and the horizontal plane. At this time, both the angles should be less than 90 degrees. The buffer groove 422 can be a straight groove or an arc groove. When the buffer groove 422 is an arc groove, the angle between the buffer groove 422 and the horizontal plane can be the angle between the tangent of the buffer groove 422 and the horizontal plane, or a curvature of the buffer groove 422 can be smaller than the angle between the guide chute 421 and the horizontal plane. In order to make the positioning shaft 210 move from the buffer groove 422 to the guide chute 421 more smoothly, the guide chute 421 and the buffer groove 422 can be connected smoothly in transition.

By making the angle between the buffer groove 422 and the horizontal plane smaller than the angle between the guide chute 421 and the horizontal plane, the buffer groove 422 is less slopy than the guide chute 421. When the driving member 410 is just started, if the positioning shaft 210 is directly arranged on the guide chute 421, due to the overly large angle between the guide chute 421 and the horizontal plane and lack of driving force, it is difficult for the positioning shaft 210 to slide along the guide chute 421. By setting the buffer groove 422 which is less slopy, when the motor is just started, the positioning shaft 210 moves in the buffer groove 422 for a period of time. When the motor operates normally, the motor drives the positioning shaft 210 to smoothly move from the buffer groove 422 to the guide chute 421, and then smoothly move in the guide chute 421.

For example, referring to FIGS. 4-9, the driving device 400 further includes a transmission gear 440, and the driving member 410 includes a driving motor. The motion conversion member 420 is provided with a rack 423 engaged with the transmission gear 440, the rack 423 is extended along the first direction. The driving motor is connected to the transmission gear 440 and configured to drive the transmission gear 440 to move the motion conversion member 420 along the first direction. The driving motor drives the transmission gear 440 to rotate, and has simple driving structure, sufficient driving force and small volume. The driving motor, the gear and the rack 423 are connected in a stable and reliable way, which is easy to realize.

In an embodiment, as shown in FIG. 9, the motion conversion member 420 includes a connecting plate 424 defined with the guide chute 421 and a toothed frame 425 connected with the connecting plate 424. The toothed frame 425 is provided with two opposite racks 423, and the transmission gear 440 is meshed with the two racks 423.

In this embodiment, the toothed frame 425 can be a frame structure and is connected to an end of the connecting plate 424. The guide chute 421 can be extended to the position of the toothed frame 425. At this time, a certain gap should be formed between the portion of the toothed frame 425 provided with the racks 423 and the connecting plate 424, so as to prevent interference between the positioning shafts 210 and the toothed frame 425. Alternatively, the guide chute 421 can also not be extended to the position of the toothed frame 425. The two opposite racks 423 are arranged in the toothed frame 425, so that a meshing area between the gear and the racks 423 is larger, and the gear is easier to drive the racks 423 to move.

In combination with the above-mentioned embodiment with the driving motor and the transmission gear 440, further, referring to FIGS. 4-9 again, there are two driving motors and two transmission gears 440, each driving motor is fixedly connected with a transmission gear 440, and the two driving motors rotate synchronously. The two transmission gears 440 are engaged with the racks 423, and the two driving motors simultaneously drive the two transmission gears 440 to rotate synchronously, thereby driving the racks 423 to move in the first direction. By utilizing two driving motors to drive the motion conversion member 420 to move along the first direction, the driving force and margin are enough for the up-and-down movement of the top air outlet frame 200. Further, motor protection covers can be provided to cover and protect the two driving motors.

Figure 12:
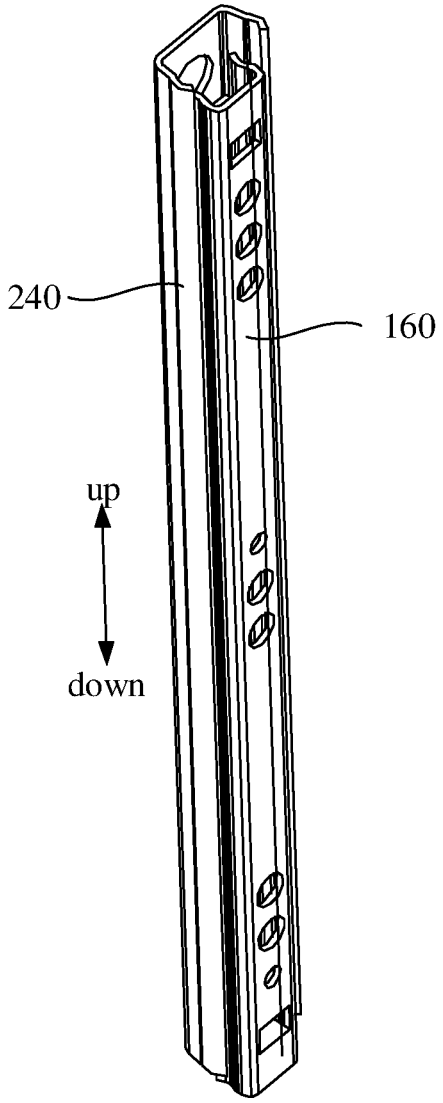
FIG. 12 is a schematic structural view of an embodiment of a sliding rail structure and a sliding groove structure of the floor-standing air-conditioning indoor unit.

In an embodiment, referring to FIGS. 6, 8 and 12, one of the top air outlet frame 200 and the housing 100 is provided with a sliding rail structure 160 extending in the up-down direction, and the other of the top air outlet frame 200 and the housing 100 is provided with a sliding groove structure 240 engaged with the sliding rail structure 160. For example, the sliding rail structure 160 can be integrally formed with the top air outlet frame 200 or the air duct housing 150, or can be formed individually, that is, the sliding rail structure 160 is a separate structure. The sliding groove structure 240 can be a sliding groove defined on the top air outlet frame 200 or on the air duct housing 150, or it can be formed by a separate structure with a sliding groove, that is, the sliding groove structure 240 and the air duct housing 150 are formed separately or the sliding groove structure 240 and the top air outlet frame 200 are formed separately. The top air outlet frame 200 and the housing 100 are slidably connected through the sliding groove and the sliding rail. On the one hand, the up-and-down movement of the top air outlet frame 200 can be smoother, on the other hand, it plays a limiting and guiding role to the up-and-down movement of the top air outlet frame 200, thereby making the movement of the top air outlet frame 200 more accurate and less likely to swing.

In an embodiment, as shown in FIGS. 1-4, the front side of the outer housing (not labeled) is provided with an air outlet 141 located below the mounting port 120, the air duct housing 150 is provided with an air outlet 153 corresponding to the air outlet 141, and the fan assembly (not shown) is also configured to drive the air flow to the air outlet 153 and be blown out from the air outlet 141.

In this embodiment, the shape of the air outlet 141 can be a circular shape, an elliptical shape, a rectangular shape, a long strip shape, multiple micropores, or the like. A grille can be provided at the air outlet 141 to prevent dust from entering the outer housing. The fan assembly (not shown) can drive the airflow into the air duct 130, blow it to the air outlet 153, and then blow it out from the air outlet 141. The top air outlet frame 200 is arranged above the air outlet 153 in the air duct housing 150. By arranging the air outlet 141 at the front side of the outer housing (not labeled), the floor-standing air-conditioning indoor unit has a conventional air outlet mode and the top air outlet mode, thereby diversifying the air supply modes or forms and greatly increasing the air supply range of the entire machine. Furthermore, with the air outlet 141 of the outer housing (not labeled) and the top air outlet frame 200, the air supply range of the entire machine in height is significantly increased, so that large-scale air supply can be realized while the entire machine is short and the occupied space is small. When foot warming is needed in winter, the air outlet of the top air outlet frame 200 can be turned off or the air outlet of the top air outlet frame 200 can be lowered, so as to make the warm airflow blow downward as much as possible, and meet the use requirements of foot warming. When large-scale refrigeration is needed in summer, air is blown through the top air outlet frame 200, so that the cold air can be blown higher and farther, and the covered range is wider, thereby meeting the requirements of large-scale refrigeration.

The application also provides a floor-standing air-conditioning indoor unit, which includes an air-conditioning outdoor unit and a floor-standing air-conditioning indoor unit which are connected through refrigerant pipes. The specific structure of the floor-standing air-conditioning indoor unit refers to the above-mentioned embodiments. Because the floor-standing air-conditioning indoor unit adopts all the technical solutions of all the above-mentioned embodiments, it at least has all the beneficial effects brought by the technical solutions of the above-mentioned embodiments, which will not be repeated here.

the above are only preferred embodiments of the present application, and are not therefore limiting the scope of the present application. Under the concept of the present application, any equivalent structural transformation made by using the contents of the specification and drawings of the present application, or any direct/indirect application in other related technical fields is included in the claimed scope of the present application.

What is claimed is:

1. A floor-standing air-conditioning indoor unit comprising:

a housing provided with an air inlet and a mounting port having an upward opening, an air duct being formed between the air inlet and the mounting port;

a top air outlet frame provided at the mounting port and movable in an up-down direction, wherein a lower end and a front end of the top air outlet frame are open;

a fan assembly provided in the air duct and configured to blow airflow from the air inlet to a lower port of the top air outlet frame and then out from a front port of the top air outlet frame; and a driving device provided in the housing and comprising a driving member and a motion conversion member driven by the driving member, wherein the driving member comprises a driving motor, wherein the motion conversion member comprises a connecting plate that is connected in sliding engagement with the top air outlet frame, and the driving member is configured to drive the connecting plate of the motion conversion member to move along a first direction and drive the top air outlet frame to move in the up-down direction based on the sliding engagement of the top air outlet frame with the connecting plate of the motion conversion member, wherein:

the housing comprises an outer housing and an air duct housing arranged in the outer housing, the mounting port is defined on a top surface of the air duct housing, and the air duct is formed inside the air duct housing, the top air outlet frame is provided in the air duct housing and movable in the up-down direction, a side wall of the top air outlet frame is provided with a positioning shaft, the motion conversion member is provided with a guide chute, the positioning shaft is arranged in the guide chute and configured to move along the guide chute to drive the top air outlet frame to move in the up-down direction when the motion conversion member moves along the first direction, a side wall of the air duct housing is provided with a second guide chute extending in the up-down direction and corresponding to the guide chute, the driving device is arranged outside the air duct housing, and the positioning shaft passes through the second guide chute and connected with the guide chute.

2. The floor-standing air-conditioning indoor unit according to claim 1, wherein:

the top air outlet frame has a first position out of the mounting port and a second position in the air duct housing, and the driving device is configured to drive the top air outlet frame to move between the first position and the second position.

3. The floor-standing air-conditioning indoor unit according to claim 1, wherein:

the positioning shaft is provided on a rear side wall of the top air outlet frame, the air duct housing is provided with a sliding groove extending along the first direction and corresponding to the rear side wall of the top air outlet frame, and the motion conversion member is slidably installed in the sliding groove, the first direction is consistent with a length direction of the air duct housing, and the guide chute is arranged at angles relative to the first direction and the up-down direction.

4. The floor-standing air-conditioning indoor unit according to claim 3, wherein:

the driving device further comprises a pressing plate connected to the housing and covering the sliding groove, and the pressing plate is configured, such that the motion conversion member is slidably installed in the sliding groove along the first direction.

5. The floor-standing air-conditioning indoor unit according to claim 1, wherein:

the first direction and the up-down direction are perpendicular to each other, and the guide chute is arranged at angles relative to both the first direction and the up-down direction.

6. The floor-standing air-conditioning indoor unit according to claim 1, wherein:

two positioning shafts and two guide chutes are provided, each positioning shaft is received in one of the two guide chutes, and the two guide chutes are parallel to each other in the first direction.

7. A floor-standing air-conditioning indoor unit comprising:

a housing provided with an air inlet and a mounting port having an upward opening, an air duct being formed between the air inlet and the mounting port;

a top air outlet frame provided at the mounting port and movable in an up-down direction, wherein a lower end and a front end of the top air outlet frame are open;

a fan assembly provided in the air duct and configured to blow airflow from the air inlet to a lower port of the top air outlet frame and then out from a front port of the top air outlet frame; and a driving device provided in the housing and comprising a driving member and a motion conversion member driven by the driving member, wherein the motion conversion member is connected with the top air outlet frame, and the driving member is configured to drive the motion conversion member to move along a first direction and drive the top air outlet frame to move in the up-down direction, wherein:

the housing comprises an outer housing and an air duct housing arranged in the outer housing, the mounting port is defined on a top surface of the air duct housing, and the air duct is formed inside the air duct housing, the top air outlet frame is provided in the air duct housing and movable in the up-down direction, a side wall of the top air outlet frame is provided with a positioning shaft, the motion conversion member is provided with a guide chute, the positioning shaft is arranged in the guide chute and configured to move along the guide chute to drive the top air outlet frame to move in the up-down direction when the motion conversion member moves along the first direction, the motion conversion member is further provided with a buffer groove arranged at a lower end of the guide chute and communicating with the guide chute, an angle formed between the buffer groove and a horizontal plane is smaller than an angle formed between the guide chute and the horizontal plane, and the buffer groove is configured, such that the driving member drives the positioning shaft to move from the buffer groove to the guide chute when the driving member is started.

8. The floor-standing air-conditioning indoor unit according to claim 7, wherein the guide chute is smoothly connected with the buffer groove.

9. The floor-standing air-conditioning indoor unit according to claim 7, wherein the buffer groove comprises an arc groove.

10. The floor-standing air-conditioning indoor unit according to claim 1, wherein:

the driving device further comprises a transmission gear, the motion conversion member is provided with a rack engaged with the transmission gear and extending in the first direction, and the driving motor is connected to the transmission gear and configured to drive the transmission gear to move the motion conversion member along the first direction.

11. The floor-standing air-conditioning indoor unit according to claim 10, wherein:

the motion conversion member comprises a toothed frame connected with the connecting plate, the toothed frame is provided with two opposite racks, and the transmission gear is meshed with the two opposite racks.

12. The floor-standing air-conditioning indoor unit according to claim 10, wherein:

two driving motors and two transmission gears are provided, each driving motor is fixedly connected with one transmission gear, and the two driving motors are configured to rotate synchronously.

13. The floor-standing air-conditioning indoor unit according to claim 1, wherein:

one of the top air outlet frame and the housing is provided with a sliding rail structure extending in the up-down direction, and the other of the top air outlet frame and the housing is provided with a sliding groove structure engaging the sliding rail structure.

14. A floor-standing air-conditioning indoor unit comprising:

a housing provided with an air inlet and a mounting port having an upward opening, an air duct being formed between the air inlet and the mounting port;

a top air outlet frame provided at the mounting port and movable in an up-down direction, wherein a lower end and a front end of the top air outlet frame are open;

a fan assembly provided in the air duct and configured to blow airflow from the air inlet to a lower port of the top air outlet frame and then out from a front port of the top air outlet frame; and a driving device provided in the housing and comprising a driving member and a motion conversion member driven by the driving member, wherein the motion conversion member is connected with the top air outlet frame, and the driving member is configured to drive the motion conversion member to move along a first direction and drive the top air outlet frame to move in the up-down direction, wherein:

the housing comprises an outer housing and an air duct housing arranged in the outer housing, the mounting port is defined on a top surface of the air duct housing, and the air duct is formed inside the air duct housing, the top air outlet frame is provided in the air duct housing and movable in the up-down direction, a front side of the housing is provided with a first air outlet located below the mounting port, the air duct housing is provided with a second air outlet corresponding to the first air outlet, and the fan assembly is further configured to drive the airflow to the second air outlet and to blow the airflow out from the air outlet.

15. The floor-standing air-conditioning indoor unit according to claim 1, wherein a top plate of the housing is provided with an exit port corresponding to the mounting port of the air duct housing and configured to allow the top air outlet frame to extend out.

16. An air conditioner comprising an air-conditioning outdoor unit and the floor-standing air-conditioning indoor unit according to claim 1, wherein the air-conditioning outdoor unit and the floor-standing air-conditioning indoor unit are connected through a refrigerant pipe.

* * * * *